US006830152B2

(12) United States Patent
Smith

(10) Patent No.: US 6,830,152 B2
(45) Date of Patent: Dec. 14, 2004

(54) GUM DISPOSAL POCKET

(76) Inventor: Nicoletta M. Smith, 1613 Chelsea Rd., Suite 141, San Marino, CA (US) 91108

( * ) Notice: Subject to any disclaimer, the term of this patent is extended or adjusted under 35 U.S.C. 154(b) by 172 days.

(21) Appl. No.: 10/073,581

(22) Filed: Feb. 12, 2002

(65) Prior Publication Data

US 2003/0150766 A1 Aug. 14, 2003

(51) Int. Cl.[7] ..... B65D 79/00
(52) U.S. Cl. ..... 206/527
(58) Field of Search ..... 206/527, 425, 206/449, 494; 229/69, 72, 75, 76, 78.1, 79; 220/890, 908

(56) References Cited

U.S. PATENT DOCUMENTS 585,816 A * 7/1897 Goodchild ..... 229/79
786,692 A * 4/1905 Stevenot ..... 229/78.1
3,017,063 A * 1/1962 Rooney ..... 229/75
3,372,724 A * 3/1968 Rouse ..... 206/496
3,426,958 A * 2/1969 Gore ..... 383/11
4,140,317 A * 2/1979 Ramney ..... 229/72
5,125,211 A * 6/1992 O'Brien et al. ..... 53/412
5,737,775 A * 4/1998 Schwartz ..... 2/247
6,032,799 A * 3/2000 Bellum et al. ..... 206/449

* cited by examiner

*Primary Examiner*—Luan K. Bui
(74) *Attorney, Agent, or Firm*—Raymond Y. Chan; David and Raymond Patent Group

(57) ABSTRACT

A gum disposal pocket includes a back wall, a pair of foldable side wings extended from two sides of the back wall respectively, a holding panel extended from a top side of the back wall and adapted for holding the pair of side wings in position, and a pocket cover extended from a top side of the front panel and adapted for closing and sealing the gum disposal pocket.

12 Claims, 3 Drawing Sheets

GUM DISPOSAL POCKET

BACKGROUND OF THE PRESENT INVENTION

1. Field of Invention

The present invention relates to means for disposing gums, and more particularly to a gum disposal pocket which can propel the general awareness of clean environment regarding gum disposal issue, and at the same time, provide means for disposing a chewed gum without polluting the environment.

2. Description of Related Arts

Chewing gums have been widespread all over the world. People usually chew gum for refreshing, for fun, for preventing tooth decay after regular meals, and the likes. Inherently, gum causes a potential pollution problem since a chewed gum cannot be swallowed and it is very sticky. Thus, if disposed inappropriately, chewed gums are extremely difficult to handle and clean, and bring great inconvenience and trouble to others, especially to those who are going to clean the chewed gums. To a large extent, inappropriately disposed gums can destroy a city's appearance and may even affect the city's image in the eyes of foreigners.

As a good practice, people should wrap a chewed gum completely by some means, such as a regular tissue, and dispose the wrapped gum into a rubbish bin. However, a lot of people do not do that if they do not have a wrapping means, such as a tissue at hands. Then, they probably throw the chewed gum directly into a rubbish bin is there is one, or simply throw the chewed gum on the street if there is no rubbish bin nearby. The most annoying thing is that one sticks a chewed gum arbitrarily such as on a wall, on an escalator's handle, or even on a bus's seat.

Unfortunately, when people start chewing gums, they usually do not keep any wrapping means. Some people use a gum's package paper to wrap the chewed gum, but the gum's package paper is not necessarily sufficient to wrap the gum completely, and thus causing the chewed but incompletely wrapped gum sticks to other stuff(s) when they are disposed into, say, a rubbish bin. In other cases, the gum itself simply does not provide a separate package to wrap a chewed gum. Moreover, for those who are used to chewing a gum for a long period of time, such as 2–3 hours, they usually do not keep even the package of the gum for proper disposal purpose. When they finish chewing, they may simply dispose the chewed gum right the way onto the street, or stick it to other physical members.

Since it is extremely simple that a gum chewer disposes his/her chewed gum arbitrarily, it has become a habit for some people. Yet it is understandable that if a gum chewer do not find any rubbish bin for them to dispose his/her chewed gum, but it is totally unacceptable that he/she still dispose their chewed gum arbitrarily if there is a rubbish bin in front of him/her and he actually gets some wrapping means. For those people, they may simply do not have sufficient public awareness that they should keep the city clean.

In the light of this, a public awareness for disposing a chewed gum properly has to be reinforced by some means. The benefit is twofold: on one hand, this reinforcement increases the general public awareness of proper gum disposal, on the other hand, this educates the next generation not to dispose a chewed gum arbitrarily, for it helps to keep the city clean.

SUMMARY OF THE PRESENT INVENTION

A main object of the present invention is to provide a gum disposal pocket which helps to reinforce a general public awareness of proper disposal of gum.

Another object of the present invention is to provide a gum disposal pocket comprising a gum disposal pocket which is simple in structure, non-adhesive, low manufacturing cost, and is capable of concealing a chewed gum for disposal purpose without polluting or affecting the environment.

Another object of the present invention is to provide a gum disposal pocket comprising a gum disposal pocket which is so simple in structure that it can be constructed by just folding of a paper.

Another object of the present invention is to provide a gum disposal pocket which is capable of propelling a clean gum disposal practice and trend.

Accordingly, in order to accomplish the above objects, the present invention provides a gum disposal unit comprising:

a gum disposal pocket which comprises:

a back wall made of foldable sheet material;

two side wings, each having an attachment hole formed thereon, extended from a left and a right side of the back wall and folded on top of the back wall in such a manner that said two attachment holes overlaps with each other and to form a pocket body having a gum cavity which has a top receiving open, wherein a width of said gum cavity is reduced gradually from the top receiving opening to a bottom of the gum cavity, and wherein the two attachment holes form a sealing openings communicating the gum cavity with an outside of the pocket body; and a pocket cover extended from a top side of the back wall and adapted for being folded to close the top receiving opening and cover the sealing opening; and a pocket dispenser having a storing chamber for storing at least one of said gum disposal pocket therein, wherein the storing chamber communicates with an outside of the gum disposal pocket container.

DETAILED DESCRIPTION OF THE PREFERRED EMBODIMENT

Figure 1:
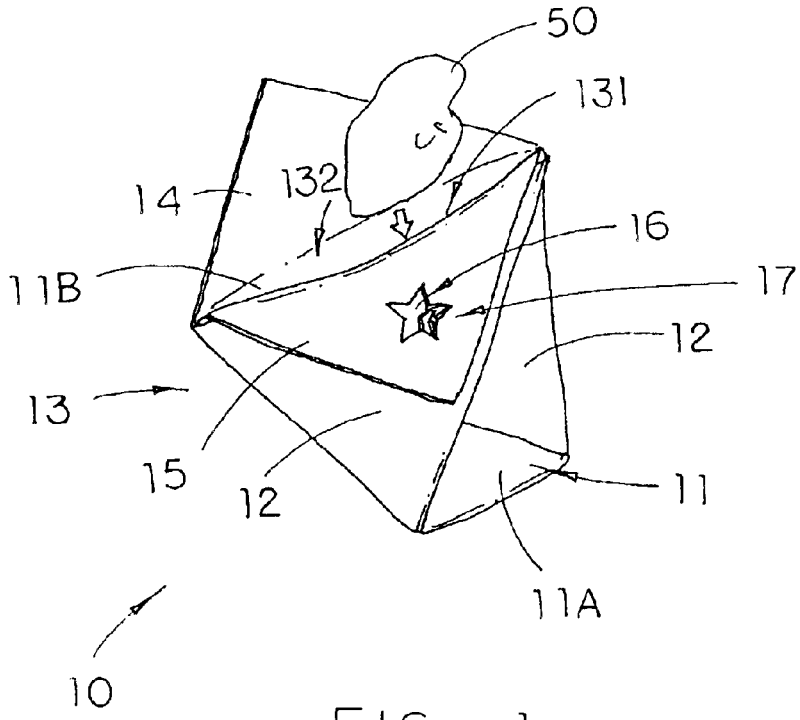
FIG. 1 is a perspective view of a gum disposal pocket according to a preferred embodiment of the present invention, illustrating that a gum cavity thereof is adapted for receiving a chewed gum.
Figure 3A:
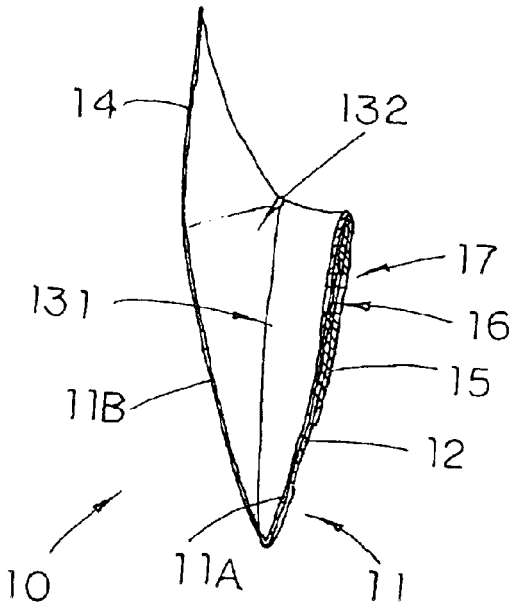
FIG. 3A is a sectional side view of the gum disposal pocket container according to the preferred embodiment of the present invention, wherein the receiving opening is in opened condition.
Figure 3B:
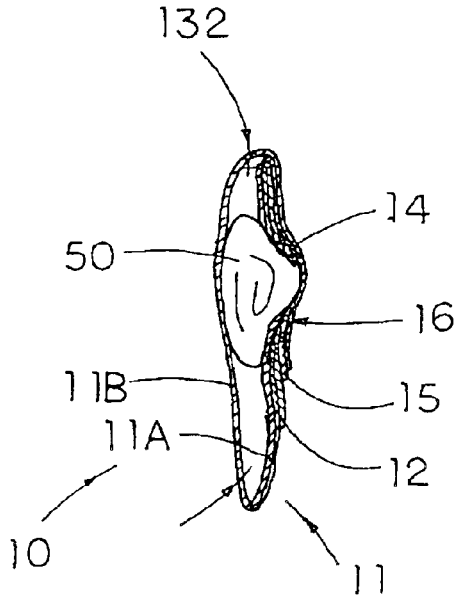
FIG. 3B is a sectional side view of the gum disposal pocket container according to the preferred embodiment of the present invention, wherein the pocket cover closes up the receiving opening.

Referring to FIGS. 1 to 4 of the drawings, a gum disposal unit according to a preferred embodiment of the present invention is illustrated. According to a preferred embodiment of the present invention, the gum disposal unit comprises a gum disposal pocket 10 for securely concealing a chewed gum 50 and a gum disposal pocket container 20 for storing at least one gum disposal pocket 10 and for facilitating easy withdrawal of it by users.

The gum disposal pocket 10 has a back wall 11 which is made of foldable sheet material such as paper, a first and a second side wings 12 which are extended from a left and a right side of the back wall 11 and folded on top of the back wall 11 to form a pocket body 13 for holding a chewed gum 50 therein, and a pocket cover 14 extended from a top side of the back wall 11 and adapted for being folded frontwardly to cover and close the pocket body 13.

The pocket body 13 has a gum cavity 131 provided therein and a top receiving opening 132 communicating the gum cavity 131 with an outside of the pocket body 13. The gum disposal pocket 10 further has means for holding the two pair of side wings in the folded position so as to completely and securely conceal a chewed gum 50 disposed inside the gum cavity 131. According to the preferred embodiment of the present invention, the holding means comprises a holding panel 15 integrally extended from the top side of the back wall 11 and folded to cover at least part of the first and the second side wings 12 so that the first and the second side wings 12 are kept in the folded position to form the pocket body 13 with the back wall 11.

The gum disposal pocket 10 is constructed by folding together a first and a second layer of sheet papers which overlap with each other, wherein the two pieces of papers are triangularly shaped and made identical. Each layer of paper has a base, a left corner portion, a right corner portion, a top corner portion and a central portion. The central portion of the triangle defines the back wall 11 of the gum disposal unit 10, and the left and the right corner portion define the first and the second side wings 12 respectively. In other words, the back wall 11 and the two side wings 12 are all constructed by two identical layers of papers stacked together.

The pair of side wings 14 and the two-layered back wall 11 form the pocket body 13, and the gum cavity 131 is therefore defined between the first layer and the second layer of the back wall 11. The holding panel 15 and the pocket cover 14 are integrally extended from a top side of the first and the second layer of the back wall 11 respectively.

In other words, the back wall 11 contains two wall layers, namely a front wall layer 11A and a back wall layer 11B , wherein the two side wings 12 substantially hold the back wall in shape and the gum cavity 131 is formed between the front wall layer 11A and the back wall layer 11B of the back wall 11.

The gum disposal pocket 10 further has four attachment holes 16 formed on the pair of side wings 12, the first layer of the back wall 11, and the holding panel 15 respectively in such a manner that when the pair of side wings 12 and the holding panel 15 are folded to conceal a chewed gum 50 inside the gum cavity 131, the four attachment holes 16 meet with each other to form a sealing opening 17 communicating the gum cavity 131 with an outside of pocket body 13.

In order to securely conceal a chewed gum 50 into the gum cavity 131, one has to open the gum cavity 131 by unfolding the pocket cover 14 and the holding panel 15, and by slightly pushing inwardly two sides of an upper portion of the gum cavity 131. Then, he/she can be able to dispose the chewed gum 50 into the gum cavity 131 and the chewed gum 50 is contacted with the sealing opening 17. Once the chewed gum 50 is disposed into the gum cavity 131, the user has to conceal the gum cavity 131 back by folding the first folding downwardly the holding panel 15 to hold the pair of side wings 12, and then folding the pocket cover 14 downwardly to close the pocket body 13. Since the chewed gum 50 is both adhesive and flexible in nature, when the user tries to push the pocket cover 14 inwardly toward the holding panel 15 in an attempt to close the pocket body 13, since there is a sealing opening 17 on the holding panel 15, thus a small portion of the chewed gum 50 will then be squeezed outwardly to touch the pocket cover 14 via the sealing opening 17. Then, the pocket cover 17 will then stick onto the small portion of the chewed gum 50 and therefore adhere to the holding panel 15 so as to securely close the pocket body 13 of the gum disposal pocket 10.

Figure 2:
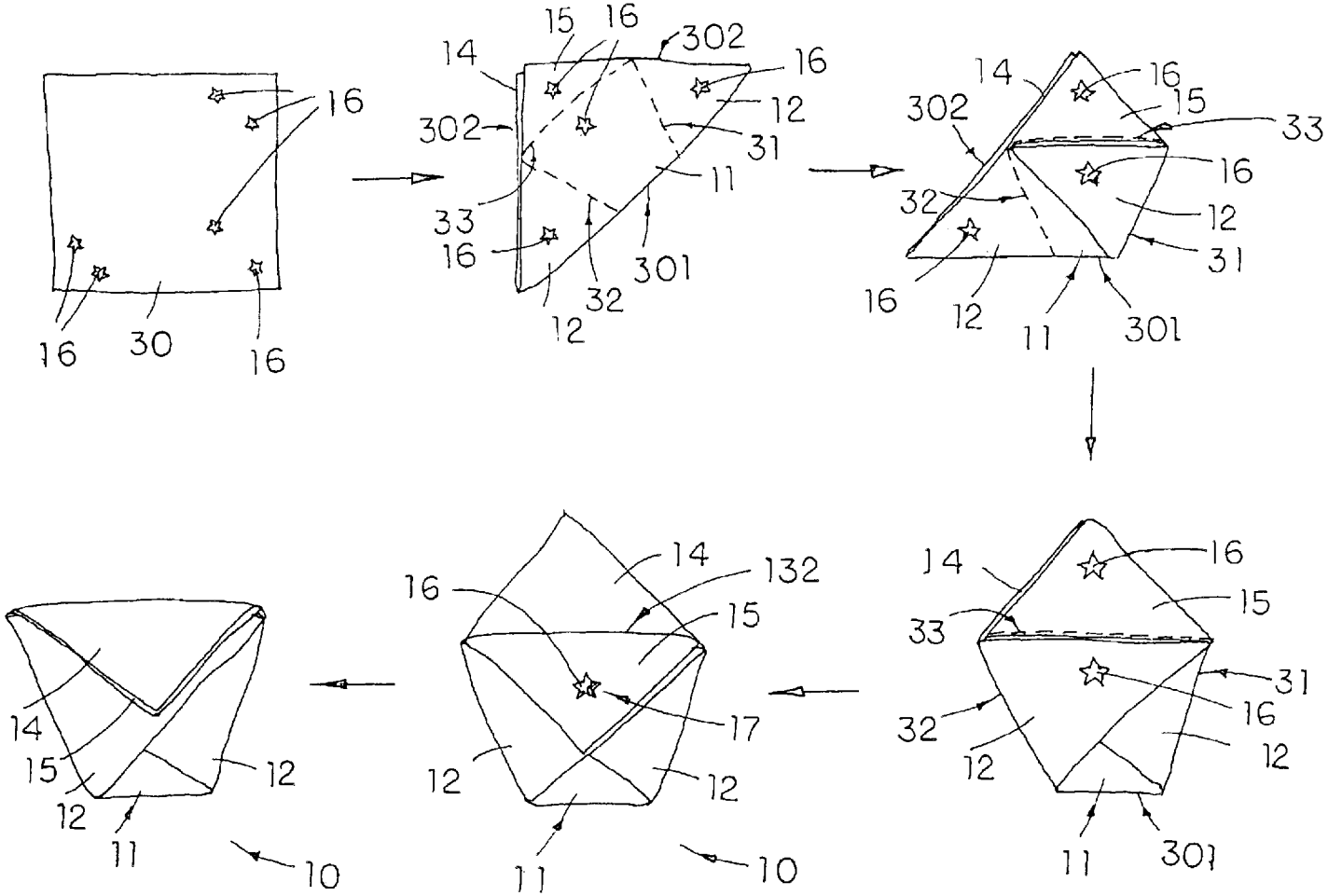
FIG. 2 is a schematic diagram illustrating a process of folding a paper into the gum disposal pocket according to the preferred embodiment of the present invention.
Figure 4:
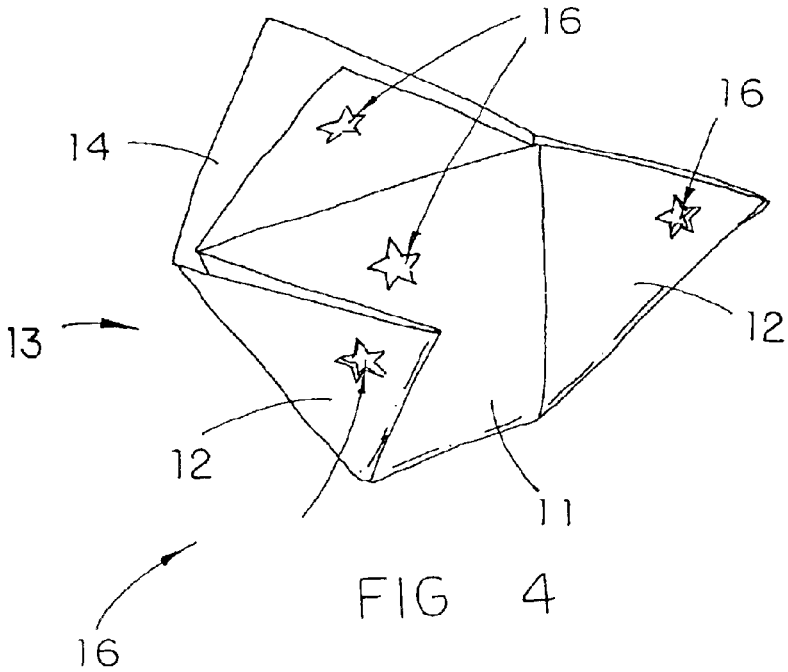
FIG. 4 is an exploded view of the gum disposal pocket container according to the preferred embodiment of the present invention.

According to the preferred embodiment of the present invention, the two layers of triangular paper each has the base connected integrally with each other. This is possible by folding a square paper diagonally into two layers of same-shaped triangular paper. Referring to FIG. 2 of the drawings, a method of producing the gum disposal pocket 10 according to the preferred embodiment of the present invention is illustrated. The method of making the gum disposal pocket 10 comprises the following steps of:

(1) Preparing a piece of square paper 30 of about 2.75 inches by 2.75 inches;
(2) Punching six holes onto six predefined positions of the square paper 30;
(3) Folding the square paper 30 diagonally into a 2-layered isosceles triangle having, wherein the isosceles triangle has the base 301 and two equal-length hypotenuses 302;
(4) Providing three folding lines 31, 32, 33 on the isosceles triangle to define the left corner portion, the right corner portion, the top corner portion, and the central portion of the isosceles triangle, wherein the first folding line 31 defines the right corner portion, the second folding line 32 defines the left corner portion, the third folding line 33 defines the top corner portion, and all three folding lines 31, 32, 33 altogether define the central portion;
(5) Folding a the right corner portion of both layers along the first folding line 31 so as to form the first side wing 12 to cover at least part of the central portion;
(6) Folding a the left corner portion of both layers along the second folding line 32 so as to form the second side wing 12 to cover the first side wing 12;
(7) Folding the top corner portion of the isosceles triangle of the first layer downwardly along the third folding line 33 to form the holding panel 15 to cover the second side wing 12; and
(8) Folding the top corner portion of the second layer of the isosceles triangle downwardly along the third folding line 33 to form the pocket cover 14 to cover the holding panel 15;

The above-mentioned eight steps of making the gum disposal holder 10 can have some variations without sacrificing the spirit of the present invention. First, step (4) and step (5) can be interchanged. That is, the sequence of folding two side wings 14 is immaterial to the final outcome of the above method. Second, step (2) can be deleted and one additional step can be added after step (8) of punching a through hole on the first side wing 14, the second side wing 14, the holding panel 15 and the first layer of the back wall 11 so as to form the sealing opening 17. Note also that instead of using paper as raw material, one can use any other suitable sheet and foldable materials.

The back wall 11 as well as the gum cavity 131 are has a trapezoidally shaped so as to obtain a gum cavity 131 that has a reducing width from the top receiving opening 132 to the base 301. By the virtue of reducing width of the gum cavity 131, the chewed gum 50 disposed inside the gum cavity 131 is guided to a central portion thereof and positioned to touch the sealing opening 17 so as to communicate with the pocket cover 14 of the gum disposal pocket 10 via the sealing opening 17.

It is worth to mention that the gum disposal pocket 10, instead of being folded by two layers of triangular papers, can also be folded by a piece of triangular paper. The single piece of triangular paper has a left corner portion, a right corner portion, a top corner portion and a central portion. The pair of side wings 12 each has one attachment hole 16 formed thereon, wherein when the pair of side wings 12 are folded to form the pocket body 13, the pair of attachment holes 16 meet with each other to form the sealing opening 17 communicating the gum cavity 131 and an outside of the pocket body 13.

Figure 5:
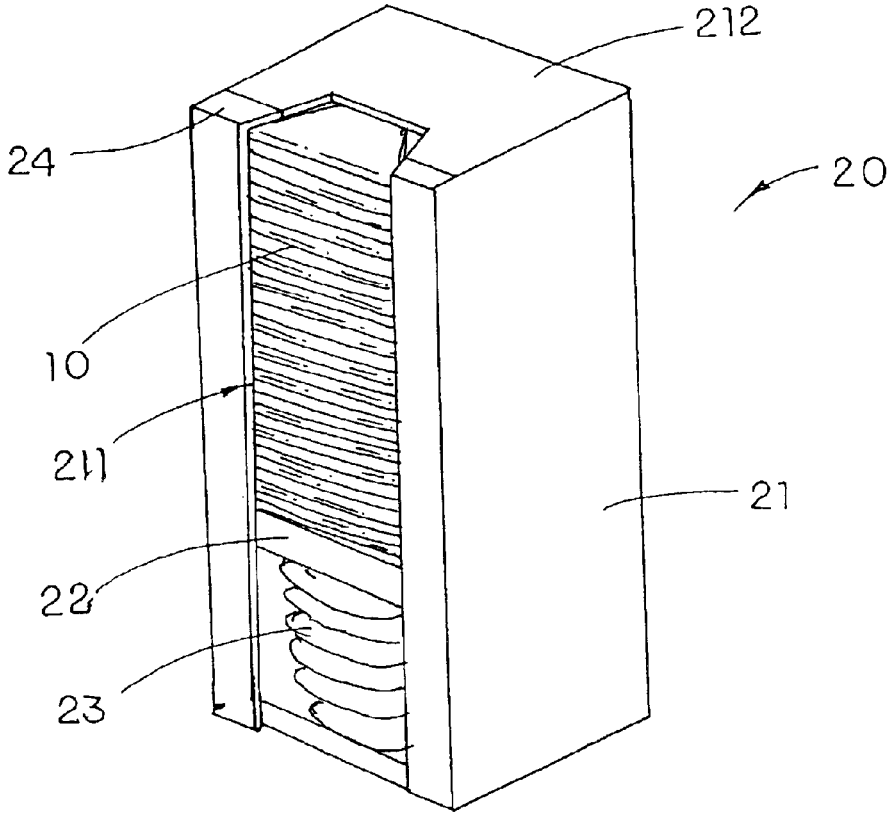
FIG. 5 is a perspective view illustrating a dispenser holding a plurality of the gum disposal pocket container according to the preferred embodiment of the present invention.

Referring to FIG. 5 of the drawings, a pocket dispenser 20 is illustrated to contain a plurality of gum disposal pocket 10 according to the preferred embodiment of the present invention. According to the preferred embodiment of the present invention, the pocket dispenser 20 comprises a main body 21 having a storing chamber 211 therein, a holding platform 22 adapted for holding at least one gum disposal pocket 10 in the storing chamber 211, a resilient element 23 mounted on the main body 21 and the holding platform 22, and a opening cover 24 movably mounted on the main body 21 for selectively closing and opening the storing chamber 211.

The resilient element 23 has one end mounted on a bottom surface of the storing chamber 211 and another end mounted on the holding platform 22 so as to normally apply an upward urging force to the holding platform 22. On the other hand, the main body 21 comprises a top cover 24 mounted on a top portion thereon so as to restrict an upward motion of the holding platform 22. Thus, the resilient element 23 can only at maximum push the holding platform upwardly to an extent that it biases against the top cover 212 of the main body 21.

When the gum disposal pocket 10 is positioned and held on the holding platform 22, the resilient element 23 will push the holding platform 22 upwardly, and the holding platform will therefore push the gum disposal pocket 10 upwardly until the gum disposal pocket 10 biases against the top cover 212 of the main body 21. In other words, the gum disposal pocket 10 will normally be held to bias against the top cover 212 of the main body 21. According to the preferred embodiment of the present invention, the resilient element 23 is a regular compressive spring.

The top cover 212 of the main body 21 is shaped to partially cover the gum disposal pocket 10 so that at least part of a gum disposal pocket 10 that directly biases against the top cover 212 is communicated with outside of the main body 21. In other words, the top cover 212, when mounted onto the main body 21, has an opening communicating the gum disposal pocket 10 with outside of the main body 21. Therefore, a user of the gum disposal pocket 10 can be able to pick one gum disposal pocket 10 from the opening of the top cover 212.

The opening cover 24 is pivotally mounted to a bottom portion of the main body 21 and adapted to cover a front portion of the main body 21. In order to load the pocket dispenser 20 with the gum disposal pocket 10, one has to open the opening cover 24, push the holding platform 22 downwardly, put the gum disposal pocket 10 onto the holding platform 22, and then close the opening cover 24.

It is worth to mention that in order to enhance the educational effect to encourage people to use the gum disposal pocket 10 for chewed gum 50, the gum disposal unit of the present invention is so designed that it is easy to use, portable and impressive so that it can be as popular as possible. One example of increasing the impressiveness of the gum disposal pocket 10 is to put some sorts of slogans on the gum disposal pocket 10. Also, it can be decorated with impressive color combinations so that it attracts people to use it. It is expected that the gum disposal unit of the present invention can propel the public awareness of proper disposal of chewed gums 50.

Equally remarkable is that the gum disposal pocket container 20 can be of any regular container such as a small box containing a plurality of gum disposal pockets 10.

What is claimed is:

1. A gum disposal unit, comprising:

a plurality of gum disposal pockets each of which comprises:

a back wall made of foldable sheet material;

two side wings, each having an attachment hole formed thereon, extended from a left and a right side of said back wall and folded on top of said back wall in such a manner that said two attachment holes overlaps with each other and to form a pocket body having a gum cavity which has a top receiving opening, wherein a width of said gum cavity is reduced gradually from said top receiving opening to a bottom of said gum cavity, and wherein said two attachment holes communicate said gum cavity with an outside of said pocket body;

a pocket cover extended from a top side of said back wall and adapted for being folded to close said top receiving opening and cover said two attachment holes; and a holding panel extended from said top side of said back wall and folded to cover on said pair of side wings so as to retain said pair of side wings in position; and a pocket dispenser having a storing chamber for storing said gum disposal pockets therein, wherein said storing chamber communicates with an outside of said gum disposal pocket container through an opening.

2. A gum disposal unit, as recited in claim 1, wherein said gum disposal pocket is constructed by two layers of triangular papers which are identical and overlapped with each other, wherein said triangular paper has a left corner portion, a right corner portion, a top corner portion, and a central portion defined between said left corner portion, said right corner portion and said top corner portion, wherein said pair of side wings are said left corner portions and said right corner portions respectively, and wherein said back wall is said central portions of said triangular papers.

3. A gum disposal unit, as recited in claim 2, wherein said gum cavity of said gum disposal pocket is defined between said first layer and said second layer of said triangular papers, and said holding panel and said pocket cover are said top corner portion of said two layers of triangular papers respectively, said holding panel further having a attachment hole formed thereon, wherein said three attachment holes overlappedly form a sealing opening communicating said gum cavity with outside of said pocket body.

4. A gum disposal unit, comprising:

a plurality of gum disposal pockets each of which comprises:

a back wall made of foldable sheet material, wherein said back wall comprises a front wall layer and a back wall layer;

two side wings, each having an attachment hole formed thereon, extended from a left and a right side of said back wall and folded on top of said back wall in such a manner that said two attachment holes overlaps with each other and to form a pocket body having a gum cavity which has a top receiving opening, wherein a width of said gum cavity is reduced gradually from said top receiving opening to a bottom of said gum cavity, and wherein said two attachment holes communicate said gum cavity with an outside of said pocket body, wherein said two side wings hold said back wall in position and said gum cavity is formed between said front wall layer and said back wall layer;

a pocket cover extended from a top side of said back wall and adapted for being folded to close said top receiving opening and cover said two attachment holes;. and a holding panel extended from said top side of said back wall and folded to cover on said pair of side wings so as to retain said pair of side wings in position; and a pocket dispenser having a storing chamber for storing said gum disposal pockets therein, wherein said storing chamber communicates with an outside of said gum disposal pocket container through an opening.

5. A gum disposal unit, as recited in claim 4, wherein said gum disposal pocket is constructed by a first and a second layer of triangular papers which are identical and overlapped with each other, wherein said triangular paper has a base, a left corner portion, a right corner portion, a top corner portion, and a central portion defined between said left corner portion, said right corner portion and said top corner portion, wherein said pair of side wings are said left corner portions and said right corner portions respectively, and wherein said back wall is said central portions of said triangular papers.

6. A gum disposal unit, as recited in claim 5, wherein said holding panel and said pocket cover are said top corner portion of said two layers of triangular papers respectively, and said holding panel and said front wall layer of said back wall further having two attachment holes formed thereon respectively, wherein said four attachment holes overlappedly form a sealing opening communicating said gum cavity with outside of said pocket body.

7. A gum disposal pocket, comprising:

a back wall made of foldable sheet material;

two side wings, each having an attachment hole formed thereon, extended from a left and a right side of said back wall and folded on top of said back wall in such a manner that said two attachment holes overlaps with each other and to form a pocket body having a gum cavity which has a top receiving opening, wherein a width of said gum cavity is reduced gradually from said top receiving opening to a bottom of said gum cavity, and wherein said two attachment holes communicate said gum cavity with an outside of said pocket body; and a holding panel extended from a top side of said back wall and folded to cover on said pair of side wings so as to retain said pair of side wings in position; and a pocket cover extended from said top side of said back wall and adapted for being folded to close said top receiving opening and cover said two attachment holes.

8. A gum disposal pocket, as recited in claim 7, wherein said gum disposal pocket is constructed by two layers of triangular papers which are identical and overlapped with each other, wherein said triangular paper has a left corner portion, a right corner portion, a top corner portion, and a central portion defined between said left corner portion, said right corner portion and said top corner portion, wherein said pair of side wings are said left corner portions and said right corner portions respectively, and wherein said back wall is said central portions of said triangular papers.

9. A gum disposal pocket, as recited in claim 8, wherein said gum cavity of said gum disposal pocket is defined between said first layer and said second layer of said triangular papers, and said holding panel and said pocket cover are said top corner portion of said two layers of triangular papers respectively, said holding panel further having a attachment hole formed thereon, wherein said three attachment holes overlappedly form a sealing opening communicating said gum cavity with outside of said pocket body.

10. A gum disposal pocket, comprising:

a back wall made of foldable sheet material, wherein said back wall comprises a front wall layer and a back wall layer;

two side wings, each having an attachment hole formed thereon, extended from a left and a right side of said back wall and folded on top of said back wall in such a manner that said two attachment holes overlaps with each other and to form a pocket body having a gum cavity which has a top receiving opening, wherein a width of said gum cavity is reduced gradually from said top receiving opening to a bottom of said gum cavity, and wherein said two attachment holes communicate said gum cavity with an outside of said pocket body, wherein said two side wings hold said back wall in position and said gum cavity is formed between said front wall layer and said back wall layer; and a holding panel extended from a top side of said back wall and folded to cover on said pair of side wings so as to retain said pair of side wings in position; and a pocket cover extended from said top side of said back wall and adapted for being folded to close said top receiving opening and cover said two attachment holes.

11. A gum disposal pocket, as recited in claim 10, wherein said gum disposal pocket is constructed by a first and a second layer of triangular papers which are identical and overlapped with each other, wherein said triangular paper has a base, a left corner portion, a right corner portion, a top corner portion, and a central portion defined between said left corner portion, said right corner portion and said top corner portion, wherein said pair of side wings are said left corner portions and said right corner portions respectively, and wherein said back wall is said central portions of said triangular papers.

12. A gum disposal pocket, as recited in claim 11, wherein said holding panel and said pocket cover are said top corner portion of said two layers of triangular papers respectively, and said holding panel and said front wall layer of said back wall further having two attachment holes formed thereon respectively, wherein said four attachment holes overlappedly form a sealing opening communicating said gum cavity with outside of said pocket body.

* * * * *